US008174490B2

(12) United States Patent
Whitesides et al.

(10) Patent No.: US 8,174,490 B2
(45) Date of Patent: May 8, 2012

(54) METHODS FOR DRIVING ELECTROPHORETIC DISPLAYS

(75) Inventors: Thomas H. Whitesides, Somerville, MA (US); Joanna F. Au, Framingham, MA (US); Karl R. Amundson, Cambridge, MA (US); Robert W. Zehner, Belmont, MA (US); Ara N. Knaian, Newton, MA (US); Benjamin Zion, State College, PA (US)

(73) Assignee: E Ink Corporation, Cambridge, MA (US)

( * ) Notice: Subject to any disclaimer, the term of this patent is extended or adjusted under 35 U.S.C. 154(b) by 940 days.

(21) Appl. No.: 11/845,919

(22) Filed: Aug. 28, 2007

(65) Prior Publication Data

US 2008/0048969 A1 Feb. 28, 2008

Related U.S. Application Data

(63) Continuation-in-part of application No. 10/879,335, filed on Jun. 29, 2004, now Pat. No. 7,528,822.

(60) Provisional application No. 60/481,040, filed on Jun. 30, 2003, provisional application No. 60/481,053, filed on Jul. 2, 2003, provisional application No. 60/481,405, filed on Sep. 22, 2003, provisional application No. 60/824,535, filed on Sep. 5, 2006.

(51) Int. Cl.
*G09G 3/34* (2006.01)

(52) U.S. Cl. ..... 345/107; 349/1; 359/296

(58) Field of Classification Search ..... 345/67, 345/107; 349/1; 359/265, 296, 452
See application file for complete search history.

(56) References Cited

U.S. PATENT DOCUMENTS

| | | | |
|---|---|---|---|
| 3,668,106 | A | 6/1972 | Ota |
| 3,756,693 | A | 9/1973 | Ota |
| 3,767,392 | A | 10/1973 | Ota |
| 3,792,308 | A | 2/1974 | Ota |
| 3,870,517 | A | 3/1975 | Ota et al. |
| 3,892,568 | A | 7/1975 | Ota |
| 3,972,040 | A | 7/1976 | Hilsum et al. |
| 4,041,481 | A | 8/1977 | Sato |
| 4,418,346 | A | 11/1983 | Batchelder |
| 4,430,648 | A | 2/1984 | Togashi et al. |
| 4,450,440 | A | 5/1984 | White |

(Continued)

FOREIGN PATENT DOCUMENTS

DE 25 23 763 12/1976

(Continued)

OTHER PUBLICATIONS

Amundson, K., "Electrophoretic Imaging Films for Electronic Paper Displays" in Crawford, G. ed. Flexible Flat Panel Displays, John Wiley & Sons, Ltd., Hoboken, NJ: 2005.

(Continued)

*Primary Examiner* — Kimnhung Nguyen
(74) *Attorney, Agent, or Firm* — David J. Cole

(57) ABSTRACT

A pixel of an electrophoretic display is driven from one extreme optical state to a second optical state different from the one extreme optical state by applying to the pixel a first drive pulse of one polarity; and thereafter applying to the pixel a second drive pulse of the opposite polarity, the second drive pulse being effective to drive the pixel to the second optical state.

23 Claims, 3 Drawing Sheets

U.S. PATENT DOCUMENTS

| | | | |
|---|---|---|---|
| 4,741,604 | A | 5/1988 | Kornfeld |
| 4,746,917 | A | 5/1988 | DiSanto et al. |
| 4,833,464 | A | 5/1989 | DiSanto et al. |
| 4,947,157 | A | 8/1990 | DiSanto et al. |
| 4,947,159 | A | 8/1990 | DiSanto et al. |
| 5,010,327 | A | 4/1991 | Wakita et al. |
| 5,066,946 | A | 11/1991 | DiSanto et al. |
| 5,177,475 | A | 1/1993 | Stephany et al. |
| 5,223,115 | A | 6/1993 | DiSanto et al. |
| 5,247,290 | A | 9/1993 | DiSanto et al. |
| 5,254,981 | A | 10/1993 | DiSanto et al. |
| 5,266,937 | A | 11/1993 | DiSanto et al. |
| 5,293,528 | A | 3/1994 | DiSanto et al. |
| 5,302,235 | A | 4/1994 | DiSanto et al. |
| 5,412,398 | A | 5/1995 | DiSanto et al. |
| 5,467,107 | A | 11/1995 | DiSanto et al. |
| 5,467,217 | A | 11/1995 | Check, III |
| 5,499,038 | A | 3/1996 | DiSanto et al. |
| 5,654,732 | A | 8/1997 | Katakura |
| 5,684,501 | A | 11/1997 | Knapp et al. |
| 5,689,282 | A | 11/1997 | Wolfs et al. |
| 5,717,515 | A | 2/1998 | Sheridon |
| 5,739,801 | A | 4/1998 | Sheridon |
| 5,745,094 | A | 4/1998 | Gordon, II et al. |
| 5,760,761 | A | 6/1998 | Sheridon |
| 5,777,782 | A | 7/1998 | Sheridon |
| 5,808,783 | A | 9/1998 | Crowley |
| 5,872,552 | A | 2/1999 | Gordon, II et al. |
| 5,892,504 | A | 4/1999 | Knapp |
| 5,896,117 | A | 4/1999 | Moon |
| 5,930,026 | A | 7/1999 | Jacobson et al. |
| 5,933,203 | A | 8/1999 | Wu et al. |
| 5,961,804 | A | 10/1999 | Jacobson et al. |
| 5,963,456 | A | 10/1999 | Klein et al. |
| 5,978,052 | A | 11/1999 | Ilcisin et al. |
| 6,002,384 | A | 12/1999 | Tamai et al. |
| 6,017,584 | A | 1/2000 | Albert et al. |
| 6,034,807 | A | 3/2000 | Little et al. |
| 6,054,071 | A | 4/2000 | Mikkelsen, Jr. |
| 6,055,091 | A | 4/2000 | Sheridon et al. |
| 6,055,180 | A | 4/2000 | Gudesen et al. |
| 6,057,814 | A | 5/2000 | Kalt |
| 6,064,410 | A | 5/2000 | Wen et al. |
| 6,067,185 | A | 5/2000 | Albert et al. |
| 6,081,285 | A | 6/2000 | Wen et al. |
| 6,097,531 | A | 8/2000 | Sheridon |
| 6,118,426 | A | 9/2000 | Albert et al. |
| 6,120,588 | A | 9/2000 | Jacobson |
| 6,120,839 | A | 9/2000 | Comiskey et al. |
| 6,124,851 | A | 9/2000 | Jacobson |
| 6,128,124 | A | 10/2000 | Silverman |
| 6,130,773 | A | 10/2000 | Jacobson et al. |
| 6,130,774 | A | 10/2000 | Albert et al. |
| 6,137,467 | A | 10/2000 | Sheridon et al. |
| 6,144,361 | A | 11/2000 | Gordon, II et al. |
| 6,147,791 | A | 11/2000 | Sheridon |
| 6,154,190 | A | 11/2000 | Yang et al. |
| 6,172,798 | B1 | 1/2001 | Albert et al. |
| 6,177,921 | B1 | 1/2001 | Comiskey et al. |
| 6,184,856 | B1 | 2/2001 | Gordon, II et al. |
| 6,211,998 | B1 | 4/2001 | Sheridon |
| 6,225,971 | B1 | 5/2001 | Gordon, II et al. |
| 6,232,950 | B1 | 5/2001 | Albert et al. |
| 6,236,385 | B1 | 5/2001 | Nomura et al. |
| 6,239,896 | B1 | 5/2001 | Ikeda |
| 6,241,921 | B1 | 6/2001 | Jacobson et al. |
| 6,249,271 | B1 | 6/2001 | Albert et al. |
| 6,252,564 | B1 | 6/2001 | Albert et al. |
| 6,262,706 | B1 | 7/2001 | Albert et al. |
| 6,262,833 | B1 | 7/2001 | Loxley et al. |
| 6,271,823 | B1 | 8/2001 | Gordon, II et al. |
| 6,300,932 | B1 | 10/2001 | Albert |
| 6,301,038 | B1 | 10/2001 | Fitzmaurice et al. |
| 6,312,304 | B1 | 11/2001 | Duthaler et al. |
| 6,312,971 | B1 | 11/2001 | Amundson et al. |
| 6,320,565 | B1 | 11/2001 | Albu et al. |
| 6,323,989 | B1 | 11/2001 | Jacobson et al. |
| 6,327,072 | B1 | 12/2001 | Comiskey et al. |
| 6,330,054 | B1 | 12/2001 | Ikami |
| 6,348,908 | B1 | 2/2002 | Richley et al. |
| 6,359,605 | B1 | 3/2002 | Knapp et al. |
| 6,373,461 | B1 | 4/2002 | Hasegawa et al. |
| 6,376,828 | B1 | 4/2002 | Comiskey |
| 6,377,387 | B1 | 4/2002 | Duthaler et al. |
| 6,392,785 | B1 | 5/2002 | Albert et al. |
| 6,392,786 | B1 | 5/2002 | Albert |
| 6,407,763 | B1 | 6/2002 | Yamaguchi et al. |
| 6,413,790 | B1 | 7/2002 | Duthaler et al. |
| 6,421,033 | B1 | 7/2002 | Williams et al. |
| 6,422,687 | B1 | 7/2002 | Jacobson |
| 6,445,374 | B2 | 9/2002 | Albert et al. |
| 6,445,489 | B1 | 9/2002 | Jacobson et al. |
| 6,459,418 | B1 | 10/2002 | Comiskey et al. |
| 6,462,837 | B1 | 10/2002 | Tone |
| 6,473,072 | B1 | 10/2002 | Comiskey et al. |
| 6,480,182 | B2 | 11/2002 | Turner et al. |
| 6,498,114 | B1 | 12/2002 | Amundson et al. |
| 6,504,524 | B1 | 1/2003 | Gates et al. |
| 6,506,438 | B2 | 1/2003 | Duthaler et al. |
| 6,512,354 | B2 | 1/2003 | Jacobson et al. |
| 6,515,649 | B1 | 2/2003 | Albert et al. |
| 6,518,949 | B2 | 2/2003 | Drzaic |
| 6,521,489 | B2 | 2/2003 | Duthaler et al. |
| 6,531,997 | B1 | 3/2003 | Gates et al. |
| 6,535,197 | B1 | 3/2003 | Comiskey et al. |
| 6,538,801 | B2 | 3/2003 | Jacobson et al. |
| 6,545,291 | B1 | 4/2003 | Amundson et al. |
| 6,580,545 | B2 | 6/2003 | Morrison et al. |
| 6,639,578 | B1 | 10/2003 | Comiskey et al. |
| 6,652,075 | B2 | 11/2003 | Jacobson |
| 6,657,772 | B2 | 12/2003 | Loxley |
| 6,664,944 | B1 | 12/2003 | Albert et al. |
| D485,294 | S | 1/2004 | Albert |
| 6,672,921 | B1 | 1/2004 | Liang et al. |
| 6,680,725 | B1 | 1/2004 | Jacobson |
| 6,683,333 | B2 | 1/2004 | Kazlas et al. |
| 6,693,620 | B1 | 2/2004 | Herb et al. |
| 6,704,133 | B2 | 3/2004 | Gates et al. |
| 6,710,540 | B1 | 3/2004 | Albert et al. |
| 6,721,083 | B2 | 4/2004 | Jacobson et al. |
| 6,724,519 | B1 | 4/2004 | Honeyman et al. |
| 6,727,881 | B1 | 4/2004 | Albert et al. |
| 6,738,050 | B2 | 5/2004 | Comiskey et al. |
| 6,750,473 | B2 | 6/2004 | Amundson et al. |
| 6,753,999 | B2 | 6/2004 | Zehner et al. |
| 6,788,449 | B2 | 9/2004 | Liang et al. |
| 6,816,147 | B2 | 11/2004 | Albert |
| 6,819,471 | B2 | 11/2004 | Amundson et al. |
| 6,822,782 | B2 | 11/2004 | Comiskey et al. |
| 6,825,068 | B2 | 11/2004 | Denis et al. |
| 6,825,829 | B1 | 11/2004 | Albert et al. |
| 6,825,970 | B2 | 11/2004 | Goenaga et al. |
| 6,831,769 | B2 | 12/2004 | Holman et al. |
| 6,839,158 | B2 | 1/2005 | Albert et al. |
| 6,842,167 | B2 | 1/2005 | Albert et al. |
| 6,842,279 | B2 | 1/2005 | Amundson |
| 6,842,657 | B1 | 1/2005 | Drzaic et al. |
| 6,864,875 | B2 | 3/2005 | Drzaic et al. |
| 6,865,010 | B2 | 3/2005 | Duthaler et al. |
| 6,866,760 | B2 | 3/2005 | Paolini, Jr. et al. |
| 6,870,657 | B1 | 3/2005 | Fitzmaurice et al. |
| 6,870,661 | B2 | 3/2005 | Pullen et al. |
| 6,900,851 | B2 | 5/2005 | Morrison et al. |
| 6,922,276 | B2 | 7/2005 | Zhang et al. |
| 6,950,220 | B2 | 9/2005 | Abramson et al. |
| 6,958,848 | B2 | 10/2005 | Cao et al. |
| 6,967,640 | B2 | 11/2005 | Albert et al. |
| 6,980,196 | B1 | 12/2005 | Turner et al. |
| 6,982,178 | B2 | 1/2006 | LeCain et al. |
| 6,987,603 | B2 | 1/2006 | Paolini, Jr. et al. |
| 6,995,550 | B2 | 2/2006 | Jacobson et al. |
| 7,002,728 | B2 | 2/2006 | Pullen et al. |
| 7,012,600 | B2 | 3/2006 | Zehner et al. |
| 7,012,735 | B2 | 3/2006 | Honeyman et al. |
| 7,023,420 | B2 | 4/2006 | Comiskey et al. |
| 7,030,412 | B1 | 4/2006 | Drzaic et al. |
| 7,030,854 | B2 | 4/2006 | Baucom et al. |

| | | | | |
|---|---|---|---|---|
| 7,034,783 | B2 | 4/2006 | Gates et al. | |
| 7,038,655 | B2 | 5/2006 | Herb et al. | |
| 7,061,663 | B2 | 6/2006 | Cao et al. | |
| 7,071,913 | B2 | 7/2006 | Albert et al. | |
| 7,075,502 | B1 | 7/2006 | Drzaic et al. | |
| 7,075,703 | B2 | 7/2006 | O'Neil et al. | |
| 7,079,305 | B2 | 7/2006 | Paolini, Jr. et al. | |
| 7,170,670 | B2 * | 1/2007 | Webber | 359/296 |
| 2001/0026260 | A1 | 10/2001 | Yoneda et al. | |
| 2002/0005832 | A1 | 1/2002 | Katase | |
| 2002/0033784 | A1 | 3/2002 | Machida et al. | |
| 2002/0033793 | A1 | 3/2002 | Machida et al. | |
| 2002/0060321 | A1 | 5/2002 | Kazlas et al. | |
| 2002/0090980 | A1 | 7/2002 | Wilcox et al. | |
| 2002/0113770 | A1 | 8/2002 | Jacobson et al. | |
| 2002/0180687 | A1 | 12/2002 | Webber | |
| 2002/0196207 | A1 | 12/2002 | Machida et al. | |
| 2002/0196219 | A1 | 12/2002 | Matsunaga et al. | |
| 2003/0011560 | A1 | 1/2003 | Albert et al. | |
| 2003/0058223 | A1 | 3/2003 | Tracy et al. | |
| 2003/0063076 | A1 | 4/2003 | Machida et al. | |
| 2003/0102858 | A1 | 6/2003 | Jacobson et al. | |
| 2003/0151702 | A1 | 8/2003 | Morrison et al. | |
| 2003/0214695 | A1 | 11/2003 | Abramson et al. | |
| 2003/0222315 | A1 | 12/2003 | Amundson et al. | |
| 2004/0014265 | A1 | 1/2004 | Kazlas et al. | |
| 2004/0051934 | A1 | 3/2004 | Machida et al. | |
| 2004/0075634 | A1 | 4/2004 | Gates | |
| 2004/0094422 | A1 | 5/2004 | Pullen et al. | |
| 2004/0105036 | A1 | 6/2004 | Danner et al. | |
| 2004/0112750 | A1 | 6/2004 | Jacobson et al. | |
| 2004/0119681 | A1 | 6/2004 | Albert et al. | |
| 2004/0120024 | A1 | 6/2004 | Chen et al. | |
| 2004/0136048 | A1 | 7/2004 | Arango et al. | |
| 2004/0150613 | A1 * | 8/2004 | Li et al. | 345/107 |
| 2004/0155857 | A1 | 8/2004 | Duthaler et al. | |
| 2004/0180476 | A1 | 9/2004 | Kazlas et al. | |
| 2004/0183759 | A1 | 9/2004 | Stevenson et al. | |
| 2004/0190114 | A1 | 9/2004 | Jacobson et al. | |
| 2004/0190115 | A1 | 9/2004 | Liang et al. | |
| 2004/0196215 | A1 | 10/2004 | Duthaler et al. | |
| 2004/0226820 | A1 | 11/2004 | Webber et al. | |
| 2004/0239587 | A1 | 12/2004 | Murata et al. | |
| 2004/0239614 | A1 | 12/2004 | Amundson et al. | |
| 2004/0246562 | A1 | 12/2004 | Chung et al. | |
| 2004/0252360 | A1 | 12/2004 | Webber et al. | |
| 2004/0257635 | A1 | 12/2004 | Paolini, Jr. et al. | |
| 2004/0263947 | A1 | 12/2004 | Drzaic et al. | |
| 2005/0001810 | A1 | 1/2005 | Yakushiji et al. | |
| 2005/0001812 | A1 | 1/2005 | Amundson et al. | |
| 2005/0007336 | A1 | 1/2005 | Albert et al. | |
| 2005/0012980 | A1 | 1/2005 | Wilcox et al. | |
| 2005/0017944 | A1 | 1/2005 | Albert | |
| 2005/0018273 | A1 | 1/2005 | Honeyman et al. | |
| 2005/0024353 | A1 | 2/2005 | Amundson et al. | |
| 2005/0035941 | A1 | 2/2005 | Albert et al. | |
| 2005/0062714 | A1 | 3/2005 | Zehner et al. | |
| 2005/0067656 | A1 | 3/2005 | Denis et al. | |
| 2005/0078099 | A1 | 4/2005 | Amundson et al. | |
| 2005/0104844 | A1 | 5/2005 | Nakai et al. | |
| 2005/0105159 | A1 | 5/2005 | Paolini, Jr. et al. | |
| 2005/0105162 | A1 | 5/2005 | Paolini, Jr. et al. | |
| 2005/0122284 | A1 | 6/2005 | Gates et al. | |
| 2005/0122306 | A1 | 6/2005 | Wilcox et al. | |
| 2005/0122563 | A1 | 6/2005 | Honeyman et al. | |
| 2005/0122564 | A1 | 6/2005 | Zehner et al. | |
| 2005/0122565 | A1 | 6/2005 | Doshi et al. | |
| 2005/0134554 | A1 | 6/2005 | Albert et al. | |
| 2005/0146774 | A1 | 7/2005 | LeCain et al. | |
| 2005/0151709 | A1 | 7/2005 | Jacobson et al. | |
| 2005/0152018 | A1 | 7/2005 | Abramson et al. | |
| 2005/0152022 | A1 | 7/2005 | Honeyman et al. | |
| 2005/0156340 | A1 | 7/2005 | Valianatos et al. | |
| 2005/0162377 | A1 | 7/2005 | Zhou et al. | |
| 2005/0168799 | A1 | 8/2005 | Whitesides et al. | |
| 2005/0168801 | A1 | 8/2005 | O'Neil et al. | |
| 2005/0179642 | A1 | 8/2005 | Wilcox et al. | |
| 2005/0190137 | A1 | 9/2005 | Duthaler et al. | |
| 2005/0212747 | A1 | 9/2005 | Amundson | |
| 2005/0213191 | A1 | 9/2005 | Whitesides et al. | |
| 2005/0219184 | A1 | 10/2005 | Zehner et al. | |
| 2005/0253777 | A1 | 11/2005 | Zehner et al. | |
| 2005/0270261 | A1 | 12/2005 | Danner et al. | |
| 2005/0280626 | A1 | 12/2005 | Amundson et al. | |
| 2006/0007527 | A1 | 1/2006 | Paolini, Jr. et al. | |
| 2006/0007528 | A1 | 1/2006 | Cao et al. | |
| 2006/0023126 | A1 * | 2/2006 | Johnson | 349/1 |
| 2006/0023296 | A1 | 2/2006 | Whitesides et al. | |
| 2006/0024437 | A1 | 2/2006 | Pullen et al. | |
| 2006/0038772 | A1 | 2/2006 | Amundson et al. | |
| 2006/0139308 | A1 | 6/2006 | Jacobson et al. | |
| 2006/0139310 | A1 | 6/2006 | Zehner et al. | |
| 2006/0139311 | A1 | 6/2006 | Zehner et al. | |
| 2006/0176267 | A1 | 8/2006 | Honeyman et al. | |
| 2006/0181492 | A1 | 8/2006 | Gates et al. | |
| 2006/0181504 | A1 | 8/2006 | Kawai | |
| 2006/0194619 | A1 | 8/2006 | Wilcox et al. | |
| 2006/0197737 | A1 | 9/2006 | Baucom et al. | |
| 2006/0197738 | A1 | 9/2006 | Kawai | |
| 2006/0202949 | A1 | 9/2006 | Danner et al. | |
| 2006/0223282 | A1 | 10/2006 | Amundson et al. | |
| 2006/0232531 | A1 | 10/2006 | Amundson et al. | |
| 2006/0262060 | A1 | 11/2006 | Amundson | |
| 2006/0279527 | A1 | 12/2006 | Zehner et al. | |
| 2006/0291034 | A1 | 12/2006 | Patry et al. | |
| 2007/0035532 | A1 | 2/2007 | Amundson et al. | |
| 2007/0035808 | A1 | 2/2007 | Amundson et al. | |

FOREIGN PATENT DOCUMENTS

| | | | |
|---|---|---|---|
| EP | 1 099 207 | B1 | 3/2002 |
| EP | 1 145 072 | B1 | 5/2003 |
| EP | 1 462 847 | | 9/2004 |
| EP | 1 482 354 | | 12/2004 |
| EP | 1 484 635 | | 12/2004 |
| EP | 1 500 971 | A1 | 1/2005 |
| EP | 1 501 194 | A1 | 1/2005 |
| EP | 1 536 271 | | 6/2005 |
| EP | 1 542 067 | | 6/2005 |
| EP | 1 577 702 | | 9/2005 |
| EP | 1 577 703 | | 9/2005 |
| EP | 1 598 694 | | 11/2005 |
| JP | 03-091722 | A | 4/1991 |
| JP | 03-096925 | A | 4/1991 |
| JP | 05-173194 | A | 7/1993 |
| JP | 06-233131 | A | 8/1994 |
| JP | 09-016116 | A | 1/1997 |
| JP | 09-185087 | A | 7/1997 |
| JP | 09-230391 | A | 9/1997 |
| JP | 11-113019 | A | 4/1999 |
| WO | WO 99/10870 | | 3/1999 |
| WO | WO 00/36560 | | 6/2000 |
| WO | WO 00/38000 | | 6/2000 |
| WO | WO 00/67110 | | 11/2000 |
| WO | WO 01/07961 | | 2/2001 |
| WO | WO 04/001498 | | 12/2003 |
| WO | WO 2004/079442 | | 9/2004 |
| WO | WO 2004/090626 | | 10/2004 |
| WO | WO 2004/107031 | | 12/2004 |
| WO | WO 2005/034074 | | 4/2005 |
| WO | WO 2005/052905 | | 6/2005 |
| WO | WO 2005/094519 | | 10/2005 |

OTHER PUBLICATIONS

Amundson, K., et al., "Flexible, Active-Matrix Display Constructed Using a Microencapsulated Electrophoretic Material and an Organic-Semiconductor-Based Backplane", SID 01 Digest, 160 (Jun. 2001).

Antia, M., "Switchable Reflections Make Electronic Ink", Science, 285, 658 (1999).

Au, J. et al., "Ultra-Thin 3.1-in. Active-Matrix Electronic Ink Display for Mobile Devices", IDW'02, 223 (2002).

Bach, U., et al., "Nanomaterials-Based Electrochromics for Paper-Quality Displays", Adv. Mater, 14(11), 845 (2002).

Bouchard, A. et al., "High-Resolution Microencapsulated Electrophoretic Display on Silicon", SID 04 Digest, 651 (2004).

Caillot, E. et al. "Active Matrix Electrophoretic Information Display for High Performance Mobile Devices", IDMC Proceedings (2003).

Chen, Y., et al., "A Conformable Electronic Ink Display using a Foil-Based a-Si TFT Array", SID 01 Digest, 157 (Jun. 2001).
Comiskey, B., et al., "An electrophoretic ink for all-printed reflective electronic displays", Nature, 394, 253 (1998).
Comiskey, B., et al., "Electrophoretic Ink: A Printable Display Material", SID 97 Digest (1997), p. 75.
Danner, G.M. et al., "Reliability Performance for Microencapsulated Electrophoretic Displays with Simulated Active Matrix Drive", SID 03 Digest, 573 (2003).
Drzaic, P., et al., "A Printed and Rollable Bistable Electronic Display", SID 98 Digest (1998), p. 1131.
Duthaler, G., et al., "Active-Matrix Color Displays Using Electrophoretic Ink and Color Filters", SID 02 Digest, 1374 (2002).
Gates, H. et al., "A5 Sized Electronic Paper Display for Document Viewing", SID 05 Digest, (2005).
Hayes, R.A., et al., "Video-Speed Electronic Paper Based on Electrowetting", Nature, vol. 425, 25 September, pp. 383-385 (2003).
Henzen, A. et al., "An Electronic Ink Low Latency Drawing Tablet", SID 04 Digest, 1070 (2004).
Henzen, A. et al., "Development of Active Matrix Electronic Ink Displays for Handheld Devices", SID 03 Digest, 176, (2003).
Henzen, A. et al., "Development of Active Matrix Electronic Ink Displays for Smart Handheld Applications", IDW'02, 227 (2002).
Hunt, R.W.G., "Measuring Color", 3d. Edn, Fountain Press (ISBN 0 86343 387 1), p. 63 (1998).
Jacobson, J., et al., "The last book", IBM Systems J., 36, 457 (1997).
Jo, G-R, et al., "Toner Display Based on Particle Movements", Chem. Mater, 14, 664 (2002).
Johnson, M. et al., "High Quality Images on Electronic Paper Displays", SID 05 Digest, 1666 (2005).
Kazlas, P. et al., "Card-size Active-matrix Electronic Ink Display", Eurodisplay 2002, 259 (2002).
Kazlas, P., et al., "12.1" SVGA Microencapsulated Electrophoretic Active Matrix Display for Information Applicances", SID 01 Digest, 152 (Jun. 2001).
Kitamura, T., et al., "Electrical toner movement for electronic paper-like display", Asia Display/IDW '01, p. 1517, Paper HCS1-1 (2001).
Mossman, M.A., et al., "A New Reflective Color Display Technique Based on Total Internal Reflection and Substractive Color Filtering", SID 01 Digest, 1054 (2001).
O'Regan, B. et al., "A Low Cost, High-efficiency Solar Cell Based on Dye-sensitized colloidal TiO2 Films", Nature, vol. 353, Oct. 24, 1991, 773-740.
Pitt, M.G., et al., "Power Consumption of Microencapsulated Electrophoretic Displays for Smart Handheld Applications", SID 02 Digest, 1378 (2002).
Poor, A., "Feed forward makes LCDs Faster", available at "http://www.extremetech.com/article2/0,3973,10085,00.asp".
Shiffman, R.R., et al., "An Electrophoretic Image Display with Internal NMOS Address Logic and Display Drivers," Proceedings of the SID, 1984, vol. 25, 105 (1984).
Singer, B., et al., "An X-Y Addressable Electrophoretic Display," Proceedings of the SID, 18, 255 (1977).
Webber, R., "Image Stability in Active-Matrix Microencapsulated Electrophoretic Displays", SID 02 Digest, 126 (2002).
Whitesides, T. et al., "Towards Video-rate Microencapsulated Dual-Particle Electrophoretic Displays", SID 04 Digest, 133 (2004).
Wood, D., "An Electrochromic Renaissance?" Information Display, 18(3), 24 (Mar. 2002).
Yamaguchi, Y., et al., "Toner display using insulative particles charged triboelectrically", Asia Display/IDW '01, p. 1729, Paper AMD4-4 (2001).
Zehner, R. et al., "Drive Waveforms for Active Matrix Electrophoretic Displays", SID 03 Digest, 842 (2003).

* cited by examiner

METHODS FOR DRIVING ELECTROPHORETIC DISPLAYS

REFERENCE TO RELATED APPLICATIONS

This application is a continuation-in-part of application Ser. No. 10/879,335, filed Jun. 29, 2004 (Publication No. 2005/0024353, now U.S. Pat. No. 7,528,822), which claims benefit of the following Provisional Applications: (a) Ser. No. 60/481,040, filed Jun. 30, 2003; (b) Ser. No. 60/481,053, filed Jul. 2, 2003; and (c) Ser. No. 60/481,405, filed Sept 22, 2003.

This application also claims benefit of Provisional Application Ser. No.60/824,535, filed Sept. 5, 2006.

This application is also related to a series of patents and applications assigned to E Ink Corporation, this series of patents and applications being directed to MEthods for Driving Electro-Optic Displays, and hereinafter collectively referred to as the "MEDEOD" applications. This series of patents and applications comprises:

(a) U.S. Pat. No. 6,504,524;

(b) U.S. Pat. No. 6,531,997;

(c) U.S. Pat. No. 7,012,600;

(d) application Ser. No. 11/160,455, filed Jun. 24, 2005 (Publication No. 2005/0219184, now U.S. Pat. No. 7,312,794);

(e) application Ser. No. 11/307,886, filed Feb. 27, 2006 (Publication No. 2006/0139310, now U.S. Pat. No. 7,733,335);

(f) application Ser. No. 11/307,887, filed Feb. 27, 2006 (Publication No. 2006/0139311, now U.S. Pat. No. 7,688,297);

(g) U.S. Pat. No. 7,193,625;

(h) copending application Ser. No. 11/611,324, filed Dec. 15, 2006 (Publication No. 2007/0091418);

(i) U.S. Pat. No. 7,119,772;

(j) application Ser. No. 11/425,408, filed Jun. 21, 2006 (Publication No. 2006/0232531, now U.S. Pat. No. 7,733,311);

(k) U.S. Pat. No. 7,170,670;

(l) copending application Ser. No. 10/904,707, filed Nov. 24, 2004 (Publication No. 2005/0179642);

(m) application Ser. No. 10/906,985, filed Mar. 15, 2005 (Publication No. 2005/0212747, now U.S. Pat. No. 7,492,339);

(n) application Ser. No. 10/907,140, filed Mar. 22, 2005 (Publication No. 2005/0213191, now U.S. Pat. No. 7,327,511);

(o) copending application Ser. No. 11/161,715, filed Aug. 13, 2005 (Publication No. 2005/0280626);

(p) copending application Ser. No. 11/162,188, filed Aug. 31, 2005 (Publication No. 2006/0038772);

(q) U.S. Pat. No. 7,230,751, issued Jun. 12, 2007 on application Ser. No. 11/307,177, filed Jan. 26, 2006, which itself claims benefit of Provisional Application Ser. No. 60/593,570, filed Jan. 26, 2005, and Provisional Application Ser. No. 60/593,674, filed Feb. 4, 2005;

(r) application Ser. No. 11/461,084, filed Jul. 31, 2006 (Publication No. 2006/0262060, now U.S. Pat. No. 7,453,445); and (s) copending application Ser. No. 11/751,879, filed May 22, 2007(Publication No. 2008/0024482). The entire contents of these patents and copending applications, and of all other U.S. patents and published and copending applications mentioned below, are herein incorporated by reference.

BACKGROUND OF INVENTION

This invention relates to methods for driving electrophoretic displays.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the E Ink patents and published applications referred to below describe electrophoretic displays in which the extreme states are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example the aforementioned white and dark blue states. The term "monochrome" may be used hereinafter to denote a drive scheme which only drives pixels to their two extreme optical states with no intervening gray states.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

The term "drive pulse" is used herein to mean any application of a voltage for a time which can potentially change the optical state of an electrophoretic medium. The term "waveform" is used herein to refer to a series of one or more drive pulses effective to cause an electrophoretic medium to change from an initial gray level to a final gray level. The term "drive scheme" is used herein to refer to a set of waveforms covering all possible transitions between all gray levels desired in an electrophoretic medium.

Particle-based electrophoretic displays, in which a plurality of charged particles move through a fluid under the influence of an electric field, have been the subject of intense research and development for a number of years. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Patent Publication No. 2005/0001810; European Patent Applications 1,462,847; 1,482,354; 1,484,635; 1,500,971; 1,501,194; 1,536,271; 1,542,067; 1,577,702; 1,577,703; and 1,598,694; and International Applications WO 2004/090626; WO 2004/079442; and WO 2004/001498. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation have recently been published describing encapsulated electrophoretic media. Such encapsulated media comprise numerous small capsules, each of which itself comprises an internal phase containing electrophoretically-mobile particles suspended in a liquid suspending medium, and a capsule wall surrounding the internal phase. Typically, the capsules are themselves held within a polymeric binder to form a coherent layer positioned between two electrodes. Encapsulated media of this type are described, for example, in U.S. Pat. Nos. 5,930,026; 5,961,804; 6,017,584; 6,067,185; 6,118,426; 6,120,588; 6,120,839; 6,124,851; 6,130,773; 6,130,774; 6,172,798; 6,177,921; 6,232,950; 6,249,271; 6,252,564; 6,262,706; 6,262,833; 6,300,932; 6,312,304; 6,312,971; 6,323,989; 6,327,072; 6,376,828; 6,377,387; 6,392,785; 6,392,786; 6,413,790; 6,422,687; 6,445,374; 6,445,489; 6,459,418; 6,473,072; 6,480,182; 6,498,114; 6,504,524; 6,506,438; 6,512,354; 6,515,649; 6,518,949; 6,521,489; 6,531,997; 6,535,197; 6,538,801; 6,545,291; 6,580,545; 6,639,578; 6,652,075; 6,657,772; 6,664,944; 6,680,725; 6,683,333; 6,704,133; 6,710,540; 6,721,083; 6,724,519; 6,727,881; 6,738,050; 6,750,473; 6,753,999; 6,816,147; 6,819,471; 6,822,782; 6,825,068; 6,825,829; 6,825,970; 6,831,769; 6,839,158; 6,842,167; 6,842,279; 6,842,657; 6,864,875; 6,865,010; 6,866,760; 6,870,661; 6,900,851; 6,922,276; 6,950,200; 6,958,848; 6,967,640; 6,982,178; 6,987,603; 6,995,550; 7,002,728; 7,012,600; 7,012,735; 7,023,420; 7,030,412; 7,030,854; 7,034,783; 7,038,655; 7,061,663; 7,071,913; 7,075,502; 7,075,703; 7,079,305; 7,106,296; 7,109,968; 7,110,163; 7,110,164; 7,116,318; 7,116,466; 7,119,759; 7,119,772; 7,148,128; 7,167,155; 7,170,670; 7,173,752; 7,176,880; 7,180,649; 7,190,008; 7,193,625; 7,202,847; 7,202,991; 7,206,119; 7,223,672; 7,230,750; 7,230,751; 7,236,790; and 7,236,792; and U.S. Patent Applications Publication Nos. 2002/0060321; 2002/0090980; 2003/0011560; 2003/0102858; 2003/0151702; 2003/0222315; 2004/0094422; 2004/0105036; 2004/0112750; 2004/0119681; 2004/0136048; 2004/0155857; 2004/0180476; 2004/0190114; 2004/0196215; 2004/0226820; 2004/0257635; 2004/0263947; 2005/0000813; 2005/0007336; 2005/0012980; 2005/0017944; 2005/0018273; 2005/0024353; 2005/0062714; 2005/0067656; 2005/0099672; 2005/0122284; 2005/0122306; 2005/0122563; 2005/0134554; 2005/0151709; 2005/0152018; 2005/0156340; 2005/0179642; 2005/0190137; 2005/0212747; 2005/0213191; 2005/0219184; 2005/0253777; 2005/0280626; 2006/0007527; 2006/0024437; 2006/0038772; 2006/0139308; 2006/0139310; 2006/0139311; 2006/0176267; 2006/0181492; 2006/0181504; 2006/0194619; 2006/0197736; 2006/0197737; 2006/0197738; 2006/0202949; 2006/0223282; 2006/0232531; 2006/0245038; 2006/0256425; 2006/0262060; 2006/0279527; 2006/0291034; 2007/0035532; 2007/0035808; 2007/0052757; 2007/0057908; 2007/0069247; 2007/0085818; 2007/0091417; 2007/0091418; 2007/0097489; 2007/0109219; 2007/0128352; and 2007/0146310; and International Applications Publication Nos. WO 00/38000; WO 00/36560; WO 00/67110; and WO 01/07961; and European Patents Nos. 1,099,207 B1; and 1,145,072 B1.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

A related type of electrophoretic display is a so-called "microcell electrophoretic display". In a microcell electrophoretic display, the charged particles and the fluid are not encapsulated within microcapsules but instead are retained within a plurality of cavities formed within a carrier medium, typically a polymeric film. See, for example, U.S. Pat. Nos. 6,672,921 and 6,788,449, both assigned to Sipix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, the aforementioned U.S. Pat. Nos. 6,130,774 and 6,172,798, and U.S. Pat. Nos. 5,872,552; 6,144,361; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; electrophoretic deposition (see U.S. Patent Publication No. 2004/0226820); and other similar techniques.) Thus, the resulting display can be flexible. Further, because the display medium can be printed (using a variety of methods), the display itself can be made inexpensively.

The bistable or multi-stable behavior of particle-based electrophoretic displays, and other electro-optic displays displaying similar behavior, is in marked contrast to that of conventional liquid crystal ("LC") displays. Twisted nematic liquid crystals act are not bi- or multi-stable but act as voltage transducers, so that applying a given electric field to a pixel of such a display produces a specific gray level at the pixel, regardless of the gray level previously present at the pixel. Furthermore, LC displays are only driven in one direction (from non-transmissive or "dark" to transmissive or "light"), the reverse transition from a lighter state to a darker one being effected by reducing or eliminating the electric field. Finally, the gray level of a pixel of an LC display is not sensitive to the polarity of the electric field, only to its magnitude, and indeed for technical reasons commercial LC displays usually reverse the polarity of the driving field at frequent intervals. In contrast, bistable electro-optic displays act, to a first approximation, as impulse transducers, so that the final state of a pixel depends not only upon the electric field applied and the time for which this field is applied, but also upon the state of the pixel prior to the application of the electric field.

A further complication in driving electrophoretic displays is the need for so-called "DC balance". As discussed in the aforementioned U.S. Pat. Nos. 6,531,997 and 6,504,524, problems may be encountered, and the working lifetime of a display reduced, if the method used to drive the display does not result in zero, or near zero, net time-averaged applied electric field across the electro-optic medium. A drive method which does result in zero net time-averaged applied electric field across the electro-optic medium is conveniently referred to a "direct current balanced" or "DC balanced".

It is, of course, also desirable to obtain the greatest possible dynamic range (the difference between the two extreme optical states, usually measured in units of L*, where L* has the usual CIE definition:

$$L^*=116(R/R_0)^{1/3}-16$$

where R is the reflectance and $R_0$ is a standard reflectance value) and contrast ratio, when driving electrophoretic displays. As discussed in some of the aforementioned patents and applications, the extreme optical states of electrophoretic displays are to some extent "soft" and the exact optical state achieved can vary with the driving method used. It should be noted that simply increasing the length of a drive pulse does not always produce the most desirable extreme optical states.

It is also desirable to obtain stable optical states from an electrophoretic display. Although electrophoretic displays are typically bistable, this bistability is not unlimited, and the optical state of an electrophoretic display gradually changes over time when the display is allowed to remain undriven. It is desirable to reduce as far as possible the "drift" of the optical state of an electrophoretic display with time, and in particular it is desirable to reduce such drift during the first few minutes after a display is driven, which is the period which a user typically keeps a single image on a display used as an E-book reader or similar device.

It has now been found that these problems may be reduced or eliminated by modification of the method used to drive an electrophoretic display.

As noted in the aforementioned copending application Ser. No. 10/879,335 (see Paragraphs 269 et seq. of Publication No. 2005/0024353), complications in determining the optimum waveform for driving an electrophoretic medium arise from a phenomenon which may be called "impulse hysteresis". Except in rare situations of extreme overdrive at the optical rails, electro-optic media driven with voltage of one polarity always get blacker, and electro-optic media driven with voltage of the opposite polarity always get whiter. However, for some electro-optic media, and in particular some encapsulated electro-optic media, the variation of optical state with impulse displays hysteresis; as the medium is driven further toward white, the optical change per unit of applied impulse decreases, but if the polarity of the applied voltage is abruptly reversed so that the display is driven in the opposed direction, the optical change per impulse unit abruptly increases. In other words the magnitude of the optical change per impulse unit is strongly dependent not only upon the current optical state but also upon the direction of change of the optical state.

This impulse hysteresis produces an inherent "restoring force" tending to bring the electro-optic medium towards middle gray levels, and confounds efforts to drive the medium from state to state with unipolar pulses (as in general gray scale image flow) while still maintaining DC balance. As pulses are applied, the medium rides the impulse hysteresis surface until it reaches an equilibrium. This equilibrium is fixed for each pulse length and is generally in the center of the optical range. For example, it has been found empirically that driving one encapsulated four gray level electro-optic medium from black to dark gray required a 100 ms×−15 V unipolar impulse, but driving it back from dark gray to black required a 300 ms×15 V unipolar impulse. This waveform was not DC balanced, for obvious reasons.

A solution to the impulse hysteresis problem is to use a bipolar drive, that is to say to drive the electro-optic medium on a (potentially) non-direct path from one gray level to the next, first applying an impulse to drive the pixel into either optical rail as required to maintain DC balance and then applying a second impulse to reach the desired optical state. For example, in the above situation, one could go from black to dark gray by applying 100 ms×−15 V of impulse, but go back from dark gray to white by first applying additional negative voltage, then positive voltage, riding the impulse curve down to the black state. Such indirect transitions also avoid the problem of accumulation of errors by rail stabilization of gray scale.

It has now been found that impulse hysteresis can usefully be exploited to provide various advantages in driving electrophoretic media, in particular improved DC balance, shortened switching times, improved extreme optical states and improved image stability.

SUMMARY OF THE INVENTION

Accordingly, this invention provides a method of driving a pixel of an electrophoretic display from one extreme optical state to a second optical state different from the one extreme optical state, the method comprising applying to the pixel a first drive pulse of one polarity; and thereafter applying to the pixel a second drive pulse of the opposite polarity, the second drive pulse being effective to drive the pixel to the second optical state. This method may hereinafter for convenience be referred to as the "reverse pre-pulse method" or "RPP method", while the first drive pulse may be referred to as the "reverse pre-pulse" or simply "pre-pulse" while the second drive pulse may be referred to as the "main" drive pulse.

In one form of this method, the second optical state is the opposed extreme optical state of the pixel. In another form of this method, the impulse of the first drive pulse is from about 15 to about 50, and preferably from about 20 to about 45, percent of the sum of the absolute values of the first and second drive pulses. In the common situation where the first and second drive pulses are simple rectangular pulses with a constant voltage (of either sign) applied for a predetermined time, the first drive pulse may occupy from about 15 to about 50, and preferably from about 20 to about 45, percent of the total time occupied by the first and second drive pulses. Either or both of the drive pulses used in the present method may include periods of zero voltage or (to put it another way) each of the drive pulses may actually comprise at least two sub-pulses separated by a period of zero voltage. There may be a pause (i.e., a period of zero voltage) between the RPP and the main pulse.

It should be noted that the RPP method of the present invention need not be symmetric, in the sense that one may choose to use a reverse pre-pulse for a transition in one direction but not use a reverse pre-pulse for a transition in the opposite direction. Thus, a transition from a first extreme optical state to a second extreme optical state may be effected using a RPP and a main pulse, but the reverse transition from the second extreme optical state to the first extreme optical state may be effected using only a main pulse. For example, there is described below with reference to FIG. 4 a specific preferred drive method for a monochrome display in which a RPP is used for a black-to-white transition but not for the reverse white-to-black transition.

The use of a RPP in accordance with the present invention need not increase the total time required for a transition between the two relevant optical states. It has been found that the use of a RPP enables the main drive pulse needed for a transition to be substantially shortened. Indeed, as illustrated in detail below, it has been found that, for example, it may be possible to replace a single conventional 250 millisecond 15 V drive pulse used for a black-to-white transition with a 60 millisecond −15V RPP followed by a 190 millisecond +15 V main pulse, with no increase in transition time but with an improved resulting white state.

The present invention is not, of course, confined to drive methods which use only a reverse pre-pulse and a main drive pulse; the present method may include additional drive pulses, as described in the patents and applications mentioned in the "Reference to Related Applications" section above. In particular, the present method may include the use of reinforcing pulses after the main drive pulse, as described in the aforementioned application Ser. No. 11/751,879. Thus, when a first pixel is driven by a method of the present invention to one extreme optical state and a second pixel is already in that extreme optical state, there may be applied to the second pixel a reinforcing pulse of the same polarity as the second drive pulse applied to the first pixel, the reinforcing pulse being applied either simultaneously with the second drive pulse or within a predetermined period after the end of the second drive pulse.

The RPP method of the present invention can provide several advantages. Firstly, the method can reduce the DC imbalance for a given transition. For example, the aforementioned case in which a single 250 millisecond 15 V drive pulse is replaced by a 60 millisecond −15V RPP followed by a 190 millisecond +15 V main pulse reduces the DC imbalance for the transition by almost 50 percent. Reducing the DC imbalance of a transition tends to make it easier to DC balance, or at least reduce the DC imbalance of, a drive scheme. (The term "drive scheme" is used herein the mean a set of all waveforms capable of effecting all transitions between gray levels of an electro-optic medium.) Secondly, the present invention enables improvement in the extreme optical states of at least some displays (i.e., it enables one to obtain whiter whites and blacker blacks) with consequent improvements in dynamic range and contrast ratio of the displays. Thirdly, the present invention can result in improvements in image stability.

The electrophoretic display used in the present invention may be of any of the types previously described. Thus, the electrophoretic display may comprise an electrophoretic medium having a single type of electrically charged particle disposed in a colored fluid. Alternatively, the electrophoretic display may comprise an electrophoretic medium having two types of electrically charged particles with different optical characteristics disposed in a fluid. In either case, the electrically charged particles and the fluid may be confined within a plurality of capsules or microcells, or may be present as a plurality of discrete droplets surrounded by a continuous phase comprising a polymeric material, so that the electrophoretic medium is of the polymer-dispersed type. The fluid may be liquid or gaseous.

This invention also provides an electrophoretic display comprising an electrophoretic medium having at least two different optical states, voltage supply means for applying a voltage to the electrophoretic medium, and a controller for controlling the voltage applied by the voltage supply means, the controller being arranged to drive the electrophoretic medium from one extreme optical state to a second optical state different from the one extreme optical state, by applying to the electrophoretic medium a first drive pulse of one polarity; and thereafter applying to the electrophoretic medium a second drive pulse of the opposite polarity, the second drive pulse being effective to drive the electrophoretic medium to the second optical state.

The present invention extends to a bistable electro-optic display, display controller or application specific integrated circuit (ASIC) arranged to carry out the method of the invention.

The displays of the present invention may be used in any application in which prior art electro-optic displays have been used. Thus, for example, the present displays may be used in electronic book readers, portable computers, tablet computers, cellular telephones, smart cards, signs, watches, shelf labels and flash drives.

DETAILED DESCRIPTION

Figure 1:
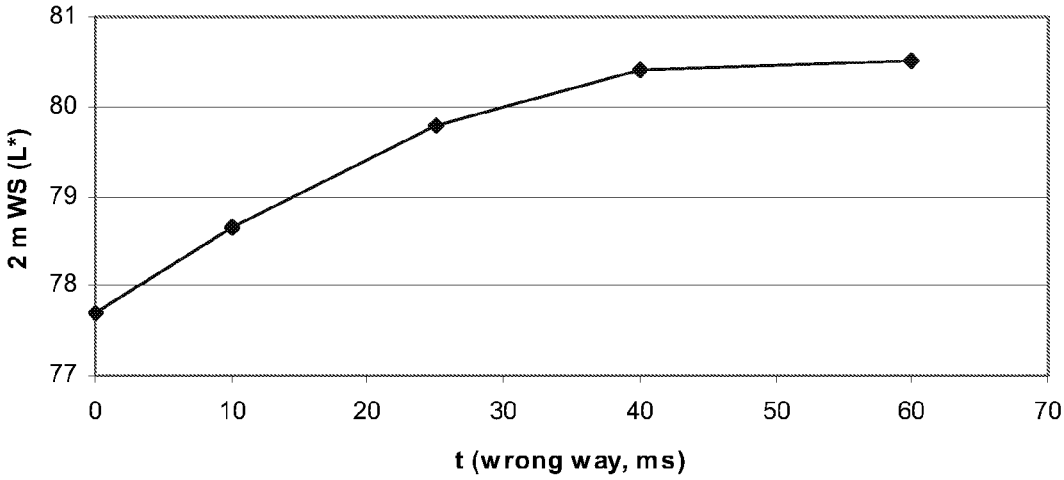
FIG. 1 of the accompanying drawings is a graph showing the white state reflectivity (converted to L* units) as a function of pre-pulse length measured during the experiments described in Example 1 below.

As already indicated, this invention relates to a method of driving an electrophoretic display in which a reverse pre-pulse is applied to a pixel which is in one of its extreme optical states, the reverse pre-pulse having a polarity which is normally used to drive the pixel towards the extreme optical state in which it already resides. The pre-pulse "drives the pixel into the optical rail" in effect trying to make an already-black pixel blacker or an already-white pixel whiter. The reverse pre-pulse is followed by a main drive pulse of the opposite polarity, which drives the pixel to a desired optical state different from its previous optical state, the desired optical state typically being the other extreme optical state of the pixel.

Although the MEDEOD applications and patents mentioned above describe many more complex drive schemes, one common technique for driving an electrophoretic display, especially if only monochrome driving is required, is to use a "square wave drive scheme" in which a drive pulse of constant voltage is applied to a pixel for a predetermined period, the polarity of the drive pulse varying of course with the direction of the transition being effected. One form of the present method modifies such a square wave drive scheme by inserting into one or more waveforms thereof a short pre-pulse of the opposite polarity before the main drive pulse. The total drive time in this process can remain unchanged. For example, if a 250 millisecond drive pulse at 15 V gives a good electro-optic response in a given display, it has been found that a waveform of the form (x) milliseconds at −15 V and (250−x) milliseconds at +15 V will, with the appropriate choice of the pre-pulse length x, gives a response that is improved in several or all of its important parameters. These include the optical states (White State, WS, and Dark State, DS, and therefore the dynamic range (DR) and contrast ratio (CR)), the image stability (IS), and the dwell time dependence (DTD); the last two parameters are defined below. The pre-pulse drive pulse length (PPPL) is a variable parameter, and has an optimal value for a given display. If the PPPL is zero, the drive is the conventional square wave drive scheme; if (reductio ad absurdum) the PPPL is equal to the total pulse length, then no drive to a second optical state will occur, and the dynamic range will be small (and probably in the wrong direction). The present invention thus gives a device designer an additional parameter (the PPPL) for use in the construction and operation of new electrophoretic display products and display media.

It has been found that, typically, reverse pre-pulses occupying about 15 to about 50, and preferably about 20 to about 45, percent of the total drive time are most useful in the present invention. The reverse pre-pulse can therefore occupy a substantial part of the total drive time. It is thus very surprising that the advantages demonstrated below can be achieved without sacrificing (and even with improving) the dynamic range of a display, since the "right-way" drive time (i.e., the time during which a voltage of the polarity tending to drive the display toward the desired optical state) is, in the present method, substantially shortened by the partitioning of the total drive time between the pre-pulse and the main drive pulse.

While this invention may be used in gray scale displays, as already noted it is believed to be particularly useful in monochrome displays, especially the so-called "direct drive" displays having a backplane comprising a plurality of pixel electrodes each of which is provided with a separate conductor connected to drive circuitry arranged to control the voltage on the associated pixel electrode. Typically, such a display will have a single ("common") front electrode, on the opposed side of the electrophoretic medium from the pixel electrodes, and extending over a large number of pixel electrodes and typically the whole display. Accordingly, the following discussion will focus on such direct drive monochrome displays, since the necessary modifications for use with other types of display will readily be apparent to those skilled in the technology of electro-optic displays. The following discussion will also focus on driving such displays so as to achieve the brightest white state and darkest dark state possible, with good image stability and dwell time dependence. The following discussion also focuses on improvements achieved at constant total drive times, although of course total drive time is a parameter subject to optimization, taking into account the properties of the electrophoretic medium used and the intended application of the display; for example, a total drive time that might be unacceptable in an E-book reader might be perfectly acceptable in a sign, such as a railroad station sign, that might be updated only about once an hour.

The Examples below use the following abbreviated nomenclature. A waveform (reverse pre-pulse and subsequent main drive pulse) is indicated in the format:

$$\text{Voltage}\times(\text{PPPL}/\text{total drive time}-\text{PPPL}).$$

Thus, a 15 V waveform with total length of 250 milliseconds (ms), using a pre-pulse of 60 ms, would be described as 15 V×(60/190 ms). As already noted, the present invention can use a pre-pulse and a main pulse having different voltage magnitudes; such a waveform is indicated by:

$$(V1\times\text{PPPL}/V2\times(\text{Total drive time}-\text{PPPL})).$$

The voltages are of course always chosen so that the pre-pulse voltage is a wrong-way drive pulse (i.e., so that it drives the display into the relevant optical rail), and the main drive pulse is right-way.

Example 1

White State Reflectivity and Dynamic Range

Figure 2:
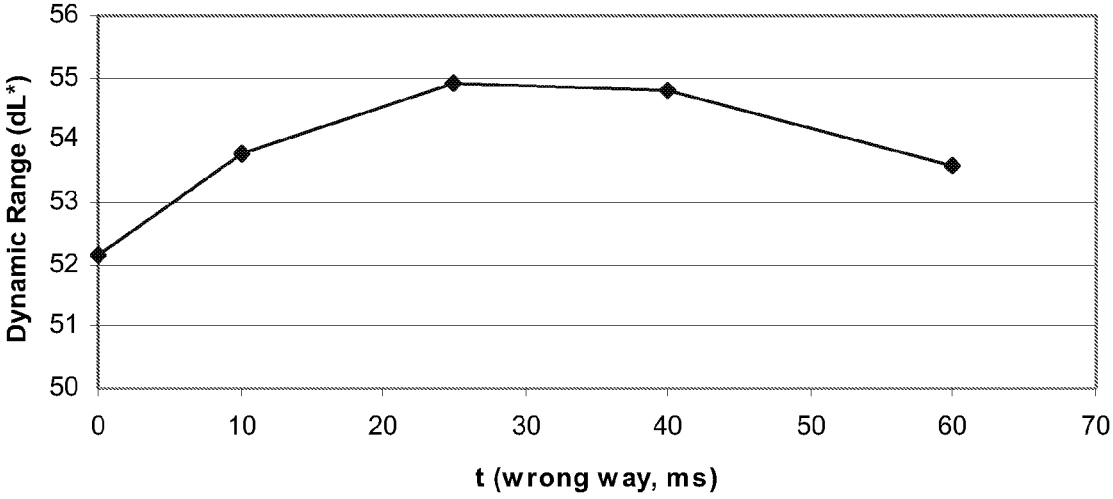
FIG. 2 is a graph showing the dynamic range as a function of pre-pulse length measured during the same series of experiments as in FIG. 1.

Experimental single-pixel electrophoretic displays having an encapsulated electrophoretic medium comprising polymer-coated titania and polymer-coated copper chromite were prepared substantially as described in Example 4 of the aforementioned U.S. Pat. No. 7,002,728, except that heptane was used as the fluid instead of Isopar E. These experimental displays were driven using drive schemes of the present invention with a voltage of 15 V and a total drive time of 250 milliseconds, the pre-pulse length varying from 0 to 60 milliseconds (the zero pre-pulse length of course provides a control example). Thus, the waveforms used varied from 15×(0/250) to 15×(60/190). In a first series of experiments, the displays were driven to their black and white states and the reflectivities of these states measured 2 minutes after the end of the waveform. FIG. 1 of the accompanying drawings shows the white state reflectivity (converted to L* units) as a function of pre-pulse length, while FIG. 2 shows the dynamic range (white state reflectivity-dark state reflectivity, both expressed in L* units) also as a function of pre-pulse length.

From FIG. 1, it will be seen that the brightness of the white state increased monotonically with pre-pulse length over the range tested, increasing from 77.7 L* at zero pre-pulse length to 80.5 L* at 60 millisecond pre-pulse length. The latter, corresponding to a reflectivity of 57.4 percent, is the brightest white state ever recorded for this type of electrophoretic medium. From FIG. 2, it will be seen that the dynamic range peaked at around 20 to 40 millisecond pre-pulse length.

Example 2

Image Stability

In a further series of experiments, the same displays as in Example 1 were tested for image stability using the same drive schemes as in Example 1 above. Experimentally, image stability is measured by driving the displays to their black or white state, measuring their reflectivity 3 seconds after the end of the waveform (this 3 second delay being used to avoid certain very short term effects which take place immediately after the end of the waveform) and again 2 minutes after the end of the waveform, the difference between the two readings, both expressed in units of L*, being the image stability. The image stability of the black and white states can of course differ, and the image stabilities of both states are plotted in FIG. 3 as a function of pre-pulse length.

Figure 3:
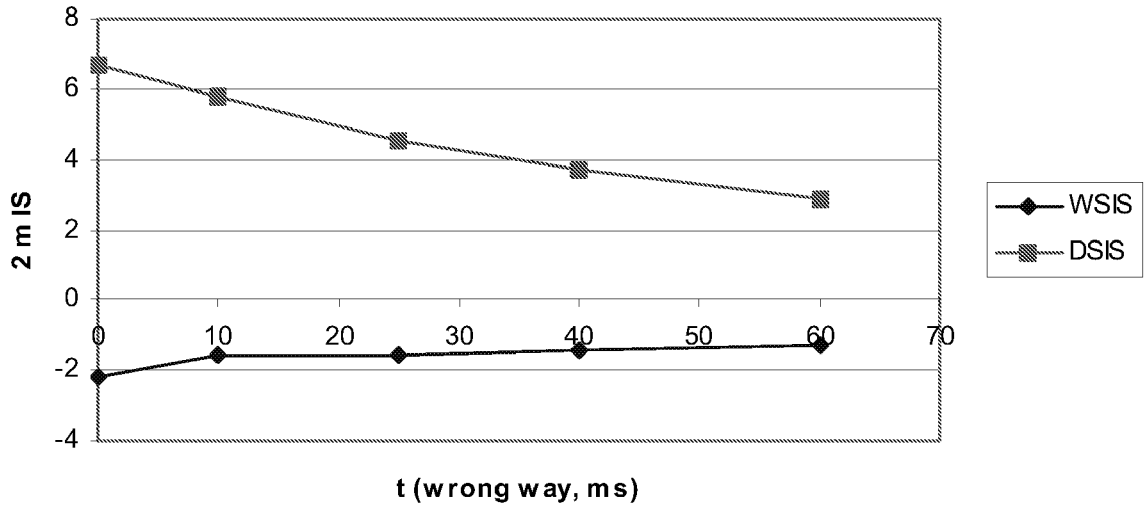
FIG. 3 is a graph showing the image stability of the black and white states of an electrophoretic medium as a function of pre-pulse length during a series of experiments described in Example 2 below.

From FIG. 3, it will be seen that increase in pre-pulse length caused a monotonic improvement (decrease) in the image stability values of both the black and white states with pre-pulse length within the range tested, although the improvement is much greater for the black state than for the white state. The black image stability at zero pre-pulse length was almost 7 L* units, which would be totally unacceptable in many applications. Using a 60 millisecond pre-pulse reduced the image stability to about 3 L* units, with a white state reflectivity greater than 56 percent, a dynamic range of 53 L* units, and a contrast ratio of 12.5, all substantially better than the values of 53 percent white state reflectivity, 52 L* units dynamic range and 10.7 contrast ratio at zero pre-pulse length.

Examples 3-9

Various Electrophoretic Media

To show that the advantageous results produced in Examples 1 and 2 above were not particular to the particular electrophoretic medium used, the experiments were repeated using differing electophoretic media. Examples 3 and 4 were essentially repetitions of the formulation used in Examples 1 and 2 above. Example 5 increased the concentration of the Solsperse 17K charge control by approximately 50 percent, while Example 6 was essentially similar to the composition used in Examples 1 and 2. Example 7 retained the original level of the Solsperse 17K but increased the level of polyisobutylene from 0.7 to 0.95 percent, while Example 8 used the increased concentrations of both Solsperse 17K and polyisobutylene. Example 9 was a composition using polymer-coated carbon black as the black pigment and was prepared substantially as described in Examples 27-29 of the aforementioned U.S. Pat. No. 6,822,782. A total driving time of 500 milliseconds was used in this Example because this medium switches more slowly than the copper chromite-based media. The results are shown in the Table below, in which bold indicates improved performance with the reverse pre-pulse drive scheme of the present invention.

TABLE

| Example No. | Drive | WS | DS | WS IS | DS IS | WS DTD | DS DTD |
|---|---|---|---|---|---|---|---|
| 3 | 15 (0/250) | 72.7 | 24.5 | −1.9 | 4.5 | 0.4 | 4.5 |
| | 15 (40/210) | **74.3** | 25 | **−1.5** | **3.4** | −0.6 | **3.4** |
| 4 | 15 (0/250) | 74.8 | 22.4 | −0.7 | 2.1 | — | — |
| | 15 (50/200) | **75.1** | 25 | **−0.6** | **1.0** | — | — |
| 5 | 15 (0/250) | 70.8 | 25.6 | −2.0 | 5.9 | 0.5 | 3.7 |
| | 15 (40/210) | **73.9** | **24.3** | −2.0 | **3.1** | **0.4** | **2.1** |
| 6 | 15 (0/250) | 69.4 | 23.1 | −2.1 | 5.5 | 1.8 | 4.1 |
| | 15 (40/210) | **73.5** | **22.4** | **−1.9** | **3.5** | **0.4** | **2.1** |
| 7 | 15 (0/250) | 70.1 | 22.9 | −1.2 | 4.4 | — | — |
| | 15 (40/210) | **73.4** | **22.7** | **−1.1** | **2.5** | 0.3 | 1.8 |
| 8 | 15 (0/250) | 71.8 | 24.7 | −0.9 | 3.4 | 1.3 | 3.7 |
| | 15 (40/210) | **75.2** | 25.1 | −0.9 | **2.4** | **0.5** | **2.1** |
| 9 | 15 (0/500 | 68.5 | 23.9 | −3.5 | 0.2 | | |
| | 15 (60/440) | 66.1 | **19.4** | **−2.8** | 1.0 | | |

From the data in the Table, it will be seen that the performance of the copper chromite and carbon black-containing media was improved by the present driving methods (compare last column with the rest) and in most cases the modified performance is preferable to that obtained with a simple square wave. In the case of copper chromite media generally, the white state brightness is improved by 1-3 L* and in all of the cases shown, the dark state is either improved or increased by a negligible amount, so that the dynamic range is also increased. In the carbon black medium, the dark state is improved (in the case shown, by more than 4 L*) with a modest decrease in the white state, with the contrast ratio improving from 9.5 to 12.5. In almost all cases, the overall image stability and dwell time dependence are improved as well, in many cases from unacceptable to acceptable (less than about 3 L*) levels. Examples 5-8 constitute a designed experiment in Solsperse 17K and poly(isobutylene) levels. When operated using 15 V (0/250 ms) (square-wave) drive, many of these formulations show clearly unacceptable image stability. The use of the present drive methods improves image stability, while at the same time yielding distinctly improved electro-optic properties, particularly white state and dynamic range. Thus the present method can enable the use of lower Solsperse levels, which in turn (in practice) improves encapsulation yields.

Example 10

Exemplary Monochrome Drive Scheme

Figure 4:
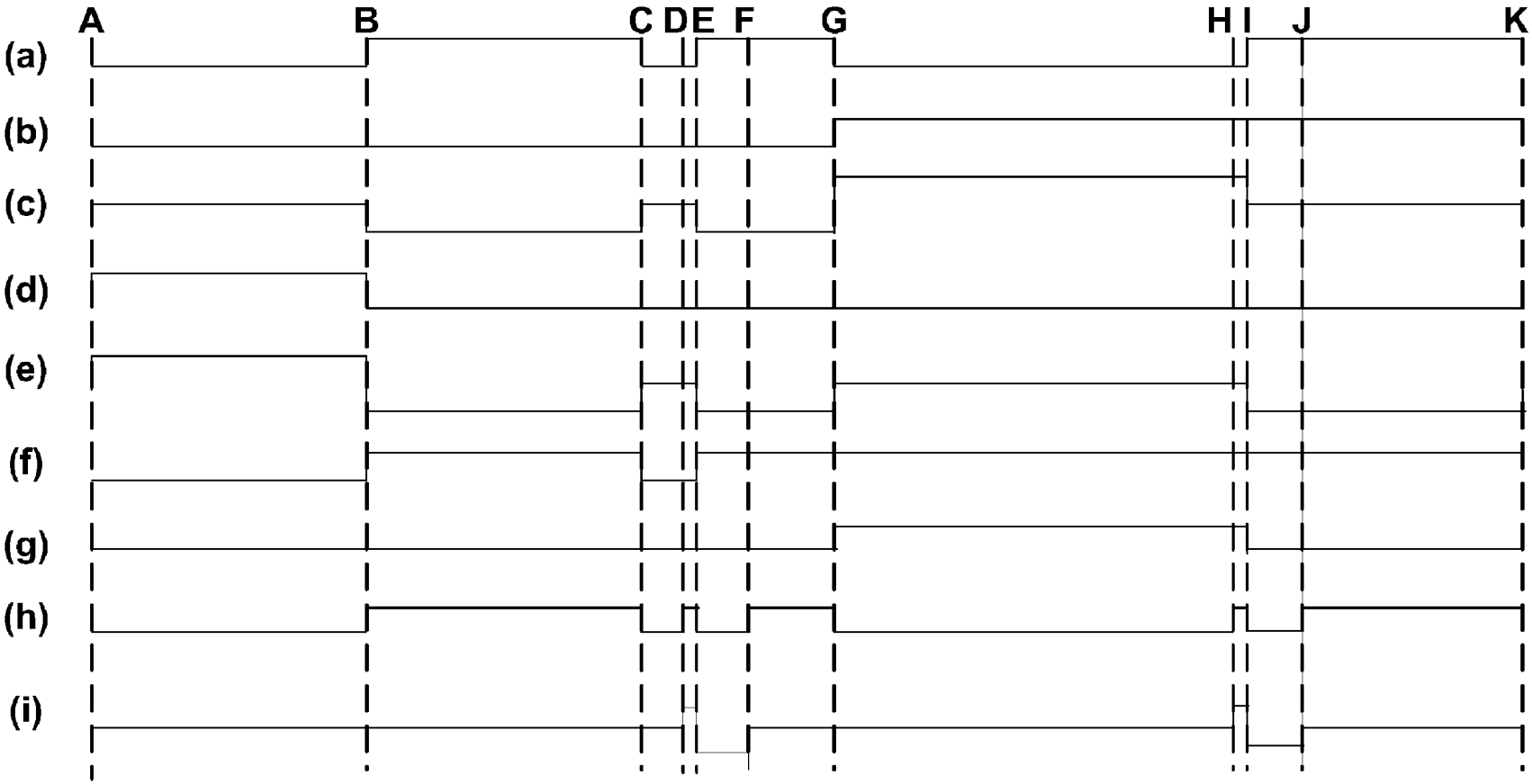
FIG. 4 shows the waveforms of a drive scheme employing the method of the present invention, as used in Example 10 below.

An exemplary monochrome drive scheme using a reverse pre-pulse in accordance with the present invention is shown in FIG. 4 of the accompanying drawings.

This drive scheme is designed for use with a simple, low cost monochrome display (useful, for example, in a digital watch updated once every minute) having a plurality of pixel electrodes on one side of the electrophoretic medium and a single common front (or "top plane") electrode on the opposed side of the electrophoretic medium and extending across the entire display, each of the pixel electrodes and the front electrode being provided with a separate conductor which enables the relevant electrode to be held at one of only two voltages, 0 or +V, where V is a driving voltage. To enable electric fields of both polarities to be applied to the electrophoretic medium, the front electrode is periodically switched between 0 and +V.

Trace (*a*) in FIG. 4 shows the voltages actually applied to the front electrode. These are, in order:

(i) 0 for 500 milliseconds (period AB in FIG. 4);

(ii) +V for 500 milliseconds (period BC);

(iii) 0 for 100 milliseconds (period CDE);

(iv) +V for 250 milliseconds (period EFG);

(v) 0 for 750 milliseconds (period GHI); and (vi) +V for 500 milliseconds (period IJK).

Trace(*b*) in FIG. 4 shows the voltages actually applied to a pixel electrode for a pixel which is undergoing a black-to-black "transition", i.e., which is black in both the initial and final images, while Trace(*c*) shows the voltage difference between the pixel electrode and the front electrode and thus represents the electric field actually applied to the electrophoretic medium. As shown in Trace(*b*), the pixel electrode is held at 0 for the first 1350 milliseconds (period ABCDEFG), then held at +V for the final 1250 milliseconds (period GHIJK). The variation of the actual applied field is more complex, however. As shown in Trace (*c*), for the first 500 milliseconds (period AB), since both the pixel electrode and the front electrode are at 0, no field is applied. For the next 500 milliseconds (period BC), with the pixel electrode at 0 and the front electrode at +V, a field of −V is applied to the electrophoretic medium, which drives the relevant pixel white. For the next 100 milliseconds (period CDE), no field is applied, while for the following 250 milliseconds (period EFG) a field of −V is applied to the electrophoretic medium, which drives the relevant pixel white. At this point G, the pixel is white. For the next 750 milliseconds (period GHI), with the pixel electrode at +V and the front electrode at 0, a field of +V is applied, which drives the pixel black; by point I the pixel is back to the desired black state. Over the period IJK, no field is applied to the pixel, which remains black.

Trace(*d*) in FIG. 4 shows the voltages applied to a pixel electrode for a pixel undergoing a black-to-white transition while Trace(*e*) shows the voltage difference between the pixel electrode and the front electrode. For the first 500 milliseconds (period AB), with the pixel electrode at +V and the front electrode at 0, a field of +V is applied to the pixel, which is thus driven black, i.e., a reverse pre-pulse is applied in accordance with the present invention. For the remainder of the transition period, the pixel electrode is held at 0. Accordingly, for the 500 millisecond period BC, a field of −V is applied to the pixel, which is thus driven white. For the period CDE, no field is applied to the pixel, for the period EFG the pixel is again driven white, for the period GHI, no field is applied to the pixel, and for the period IJK, the pixel is again driven white. The next result is that the pixel is driven black for 500 milliseconds and white for 1250 milliseconds, and ends up white. Note that, at point G, the pixel is already white.

Trace(*f*) in FIG. 4 shows the voltages applied to a pixel electrode for a pixel undergoing a white-to-black transition while Trace(*g*) shows the voltage difference between the pixel electrode and the front electrode. For the entire period ABCDEFG, the pixel electrode is held at the same voltage as the front electrode, so that no field is applied to the pixel. Note that there is no reverse pre-pulse used in this white-to-black transition, so that the illustrated drive scheme is asymmetric in the sense used above. Note also that at point G the pixel is still in its original white state. The pixel electrode is held at +V over the 750 millisecond period GHI, while the front electrode is at 0, so that a voltage of +V is applied across the pixel, which is thus driven black. Finally, over the period IJK, no voltage is applied across the pixel.

It will be noted that the net effect of the white-to-black waveform shown in FIG. 4 is a 750 millisecond +V pulse, while the net effect of the black-to-white waveform shown in this Figure is a 500 millisecond +V pulse followed by a 1250 millisecond −V pulse. Thus, the drive scheme shown in FIG. 4 is DC balanced for white-black-white or black-white-black loops.

Finally, Trace(*h*) in FIG. 4 shows the voltages applied to a pixel electrode for a pixel undergoing a white-to-white "transition" while Trace(*i*) shows the voltage difference between the pixel electrode and the front electrode. Over the entire period ABCD, the pixel electrode and the front electrode are held at the same voltage and no field is applied to the pixel. Over the 20 millisecond period DE, the pixel electrode is at +V and the front electrode at 0, while for the 80 millisecond period EF these potentials are reversed. Thus, the pixel experiences a 20 millisecond black-going pulse during period DE followed by an 100 millisecond white-going pulse during period EF. These two pulses together constitute a "double reinforcing pulse" as described in the aforementioned application Ser. No. 11/751,879, and are provided to ensure that the white color of the pixel undergoing the white-to-white transition matches the white color of the pixels undergoing the black-black and black-white transitions as described in this copending application. Over the period FG no field is applied to the pixel, so that at point G, the pixel is in its white state, newly "refreshed" by the double reinforcing pulse. Over period GH no field is again applied to the pixel. However, the period HIJ repeats the period DEF, thus applying a second double reinforcing pulse to the pixel to ensure that the color of the pixel matches the final white color of the pixel undergoing a black-to-white transition. Finally, over the period JK no field is applied to the pixel. The net effect of the waveform shown in Trace(*i*) is a 160 millisecond white-going pulse, which causes a small but tolerable DC imbalance in the drive scheme.

Although the drive scheme shown in FIG. 4 has a total length of 2600 milliseconds, the apparent length of the transition seen by an observer is only 2100 milliseconds since the only action taken during the first 500 millisecond period AB is the application of a black-going pulse to a black pixel, and such a pulse is not normally visible to an observer. At point G of the drive scheme all the pixels are white; hence, the drive scheme produces a visually pleasing transition, with the originally black pixels fading until the display is a uniform white, from which the black pixels of the new image then re-emerge. The drive scheme shown in FIG. 4 has been found to give good results with an electrophoretic medium generally similar to that used in Examples 1 and 2 above but using Isopar E as the suspending fluid; the FIG. 4 drive scheme produced a white state of 70 L* (40 percent reflectivity) and a dark state of 28 L* (5.5 percent reflectivity), and exhibited minimal ghosting.

Numerous changes and modifications can be made in the preferred embodiments of the present invention already described without departing from the scope of the invention. For example, the present invention may be useful with non-electrophoretic electro-optic media which exhibit behavior similar to electrophoretic media. Accordingly, the foregoing description is to be construed in an illustrative and not in a limitative sense.

The invention claimed is:

1. A method of driving a first pixel of an electrophoretic display from one extreme optical state to the opposed extreme optical state, the method comprising applying to the first pixel a first drive pulse of one polarity; and thereafter applying to the first pixel a second drive pulse of the opposite polarity, the second drive pulse being effective to drive the first pixel to the opposed extreme optical state and wherein a second pixel is already in that opposed extreme optical state, and there is applied to the second pixel a reinforcing pulse of the same polarity as the second drive pulse applied to the first pixel, the reinforcing pulse being applied either simultaneously with the second drive pulse or within a predetermined period after the end of the second drive pulse.

2. A method according to claim 1 wherein the impulse of the first drive pulse is from about 15 to about 50 per cent of the sum of the absolute values of the first and second drive pulses.

3. A method according to claim 2 wherein the impulse of the first drive pulse is from about 20 to about 45 per cent of the sum of the absolute values of the first and second drive pulses.

4. A method according to claim 1 wherein at least one of the first and second drive pulses comprises at least two sub-pulses separated by a period of zero voltage.

5. A method according to claim 1 wherein the first and second drive pulses are separated by a period of zero voltage.

6. A method according to claim 1 wherein the electrophoretic display comprises an electrophoretic medium having a single type of electrically charged particle disposed in a colored fluid.

7. A method according to claim 6 wherein the electrically charged particle and the fluid are confined within a plurality of capsules or microcells.

8. A method according to claim 6 wherein the electrically charged particles and the fluid are present as a plurality of discrete droplets surrounded by a continuous phase comprising a polymeric material.

9. A method according to claim 1 wherein the electrophoretic display comprises an electrophoretic medium having two types of electrically charged particles with different optical characteristics disposed in a fluid.

10. A method according to claim 9 wherein the electrically charged particle and the fluid are confined within a plurality of capsules or microcells.

11. A method according to claim 9 wherein the electrically charged particles and the fluid are present as a plurality of discrete droplets surrounded by a continuous phase comprising a polymeric material.

12. A method according to claim 1 wherein the electrophoretic display comprises an electrophoretic medium comprising at least one type of electrically charged particle disposed in a gaseous fluid.

13. An electronic book reader, portable computer, tablet computer, cellular telephone, smart card, sign, watch, shelf label or flash drive comprising a display arranged to carry out a method according to claim 1.

14. A method of driving a pixel of an electrophoretic display from one extreme optical state to a second optical state different from the one extreme optical state, the method comprising applying to the pixel a first drive pulse of one polarity; and thereafter applying to the pixel a second drive pulse of the opposite polarity, the second drive pulse being effective to drive the pixel to the second optical state and wherein the first and second drive pulses are simple rectangular pulses with a constant voltage of either sign applied for a predetermined time.

15. An electronic book reader, portable computer, tablet computer, cellular telephone, smart card, sign, watch, shelf label or flash drive comprising a display arranged to carry out a method according to claim 14.

16. A method of driving a pixel of an electrophoretic display from one extreme optical state to a second optical state different from the one extreme optical state, the method comprising applying to the pixel a first drive pulse of one polarity; and thereafter applying to the pixel a second drive pulse of the opposite polarity, the second drive pulse being effective to drive the pixel to the second optical state and wherein a transition from a first extreme optical state to a second extreme optical state is effected using the first and second drive pulses, but a transition from the second extreme optical state to the first extreme optical state is effected using one or more pulses of a single polarity.

17. An electronic book reader, portable computer, tablet computer, cellular telephone, smart card, sign, watch, shelf label or flash drive comprising a display arranged to carry out a method according to claim 16.

18. An electrophoretic display comprising an electrophoretic medium having at least two different optical states, voltage supply means for applying a voltage to the electrophoretic medium, and a controller for controlling the voltage applied by the voltage supply means, the controller being arranged to drive a first pixel of the electrophoretic medium from one extreme optical state to the opposed extreme optical state by applying to the first pixel of the electrophoretic medium a first drive pulse of one polarity; and thereafter applying to the first pixel of the electrophoretic medium a second drive pulse of the opposite polarity, the second drive pulse being effective to drive the first pixel of the electrophoretic medium to the opposed extreme optical state, and wherein, when a second pixel of the electrophoretic medium is already in that opposed extreme optical state, to apply to the second pixel a reinforcing pulse of the same polarity as the second drive pulse applied to the first pixel, the reinforcing pulse being applied either simultaneously with the second drive pulse or within a predetermined period after the end of the second drive pulse.

19. An electronic book reader, portable computer, tablet computer, cellular telephone, smart card, sign, watch, shelf label or flash drive comprising a display according to claim 18.

20. An electrophoretic display comprising an electrophoretic medium having at least two different optical states, voltage supply means for applying a voltage to the electrophoretic medium, and a controller for controlling the voltage applied by the voltage supply means, the controller being arranged to drive the electrophoretic medium from one extreme optical state to a second optical state different from the one extreme optical state, by applying to the electrophoretic medium a first drive pulse of one polarity; and thereafter applying to the electrophoretic medium a second drive pulse of the opposite polarity, the second drive pulse being effective to drive the electrophoretic medium to the second optical state, wherein the first and second drive pulses are simple rectangular pulses with a constant voltage of either sign applied for a predetermined time.

21. An electronic book reader, portable computer, tablet computer, cellular telephone, smart card, sign, watch, shelf label or flash drive comprising a display according to claim 20.

22. An electrophoretic display comprising an electrophoretic medium having at least two different optical states, voltage supply means for applying a voltage to the electrophoretic medium, and a controller for controlling the voltage applied by the voltage supply means, the controller being arranged to drive the electrophoretic medium from one extreme optical state to a second optical state different from the one extreme optical state, by applying to the electrophoretic medium a first drive pulse of one polarity; and thereafter applying to the electrophoretic medium a second drive pulse of the opposite polarity, the second drive pulse being effective to drive the electrophoretic medium to the second optical state, and wherein the controller is arranged so that a transition from a first extreme optical state to a second extreme optical state is effected using the first and second drive pulses, but a transition from the second extreme optical state to the first extreme optical state is effected using one or more pulses of a single polarity.

23. An electronic book reader, portable computer, tablet computer, cellular telephone, smart card, sign, watch, shelf label or flash drive comprising a display according to claim 22.

* * * * *